US010173235B2

(12) United States Patent
Lin et al.

(10) Patent No.: US 10,173,235 B2
(45) Date of Patent: Jan. 8, 2019

(54) SHOWER HEAD WITH WATER STOP FUNCTION AND WATERWAY SWITCH FUNCTION

(71) Applicant: XIAMEN SOLEX HIGH-TECH INDUSTRIES CO., LTD., Xiamen, Fujian (CN)

(72) Inventors: Fengde Lin, Fujian (CN); Tianming Wang, Fujian (CN); Mingfu Zhang, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 60 days.

(21) Appl. No.: 15/379,900

(22) Filed: Dec. 15, 2016

(65) Prior Publication Data

US 2017/0320084 A1 Nov. 9, 2017

(30) Foreign Application Priority Data

May 9, 2016 (CN) ..... 2016 1 0301013

(51) Int. Cl.

| | |
|---|---|
| ***B05B 1/16*** | (2006.01) |
| ***B05B 1/18*** | (2006.01) |
| ***B05B 1/30*** | (2006.01) |
| ***B05B 12/00*** | (2018.01) |
| ***B05B 15/62*** | (2018.01) |

(52) U.S. Cl.

CPC ..... *B05B 12/002* (2013.01); *B05B 1/16* (2013.01); *B05B 1/1627* (2013.01); *B05B 1/18* (2013.01); *B05B 1/3026* (2013.01); *B05B 15/62* (2018.02)

(58) Field of Classification Search

CPC .. B05B 1/16; B05B 1/18; B05B 1/185; B05B 1/3026; B05B 12/002; B05B 15/061; B05B 15/62

See application file for complete search history.

(56) References Cited

U.S. PATENT DOCUMENTS

| | | | | |
|---|---|---|---|---|
| 8,113,442 | B2 * | 2/2012 | Li | B05B 1/18 239/11 |
| 2009/0200401 | A1 * | 8/2009 | Esche | B05B 1/1618 239/525 |
| 2010/0237160 | A1 * | 9/2010 | Miller | B05B 1/1681 239/1 |
| 2012/0233768 | A1 * | 9/2012 | Kull | B05B 1/1609 4/615 |

(Continued)

*Primary Examiner* — Darren W Gorman

(74) *Attorney, Agent, or Firm* — Rabin & Berdo, P.C.

(57) ABSTRACT

A shower head with water stop function and waterway switch function, includes a housing, a switch device and a water stop device; the switch device and the water stop device are disposed in the housing, the switch device has a switch mechanism and a swing mechanism connected together in driving way, the swing mechanism pushes the switch mechanism to switch waterways; the water stop device comprises a valve shaft and a valve spool connected together, and the valve shaft drives the valve spool to move axially in an open position and a close position to open and close the waterway; further comprising a control device, the control device comprises a button and a link mechanism, the central portion of the button is pivoted to the housing, the link mechanism is connected between the valve shaft and the button in driving way.

12 Claims, 5 Drawing Sheets

(56) References Cited

U.S. PATENT DOCUMENTS

2012/0305116 A1* 12/2012 Zhou ..... B05B 1/1636
137/625.46
2012/0312403 A1* 12/2012 Zhou ..... B05B 1/1609
137/861
2014/0014743 A1* 1/2014 Schorn ..... B05B 1/16
239/447

* cited by examiner

SHOWER HEAD WITH WATER STOP FUNCTION AND WATERWAY SWITCH FUNCTION

FIELD OF THE INVENTION

The present invention relates to a shower head with water stop function and waterway switch function.

BACKGROUND OF THE INVENTION

There are single-waterway shower heads and multi-waterway shower heads according to different number of waterways; a single-waterway shower head can only outlet one kind of water type, and a multi-waterway shower head can outlet different water types by switching the switch mechanism. There are shower heads without water stop function and shower heads with water stop function according to different on-off method, a shower head without water stop function can only open or cut off the waterway by the main switch of the shower device, while a shower head with water stop function can achieve water stop function individually without taking influence to other outlet component of the shower device by operating the waterway on-off component disposed in the shower head. To enrich the functions of the shower head, someone combines the multi-waterway shower head and the shower head with water stop function. Although this kind of shower head with waterway switch function and water stop function has rich functions, the switch mechanism and the waterway on-off component work individually, the switch mechanism and the waterway switch component have individual operation button, making the shower head with many buttons and occupy large space, resulting in a large size of the shower head.

SUMMARY OF THE INVENTION

The present invention is provided with a shower head with water stop function and waterway switch function that has less buttons and compact structure to overcome the disadvantages of the existing known technology. The technical proposal of the present invention is that: A shower head with water stop function and waterway switch function, comprising a housing, a switch device and a water stop device, the switch device and the water stop device are disposed in the housing, the switch device comprises a switch mechanism and a swing mechanism connected together in driving way, the swing mechanism pushes the switch mechanism to switch the waterways; the water stop device comprises a valve shaft and a valve spool connected together, the valve shaft drives the valve spool to move axially in an open position and a close position to turn on and turn off the waterway; wherein further comprising a control device, the control device comprises a button and a link mechanism, the central portion of the button is pivoted to the housing, the link mechanism is connected between the valve shaft and the button in driving way;

when the front portion of the button is pressed, the button pushes the swing mechanism to achieve waterway switch, the button drives the link mechanism to make the valve spool open the waterway;

when the rear portion of the button is pressed, the button pulls the link mechanism to make the valve close the waterway.

Compared to the existing known technology, the technical proposal of the present invention has advantages;

1. The control device is disposed with the switch device and the water stop device, pressing the front portion of the button can achieve waterway switch, pressing the rear portion of the button can achieve water stop, the switch device and the water stop device work independently without influence, it feels light in switch, single hand operation is available, the switch device and the water stop device share a button, the structure is simple with less parts, the shower head is compact in structure.
2. The link mechanism comprises a push rod and a pendulum rod, the central portion of the pendulum rod is disposed with a groove, the front end portion of the push rod is disposed in the groove, the pendulum rod doesn't pull the valve shaft, the waterway is open; the front end portion of the push rod moves out of the groove and abuts against the pendulum rod to push the pendulum rod to rotate, so that the pendulum rod pulls the valve shaft to close the waterway, the structure is simple. The push rod withstands the pendulum rod that it can keep the waterway in close state.
3. The connecting pipe is disposed with a through hole, during the valve spool switched in the open position and the close position, air in the connecting pipe is connected to the outer side, air can not work on the valve pool, the water stop component is prevented from being locked.
4. The valve spool has two ends with same section area, so that the switch force of the valve spool is light and won't change with the water pressure increases in water supplying state or in water stop state.

BRIEF DESCRIPTION OF THE DRAWINGS

The present invention will be further described with the drawings and the embodiments.

DETAILED DESCRIPTION OF THE EMBODIMENTS

Figure 1:
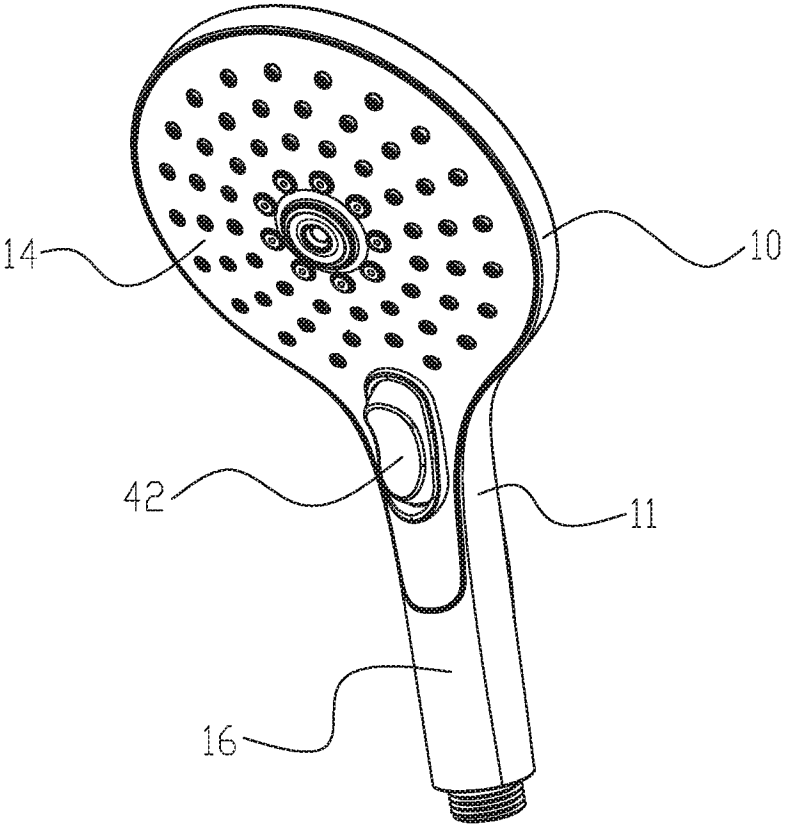
FIG. 1 illustrates a schematic diagram of a shower head with water stop function and waterway switch function of the present invention.
Figure 2:
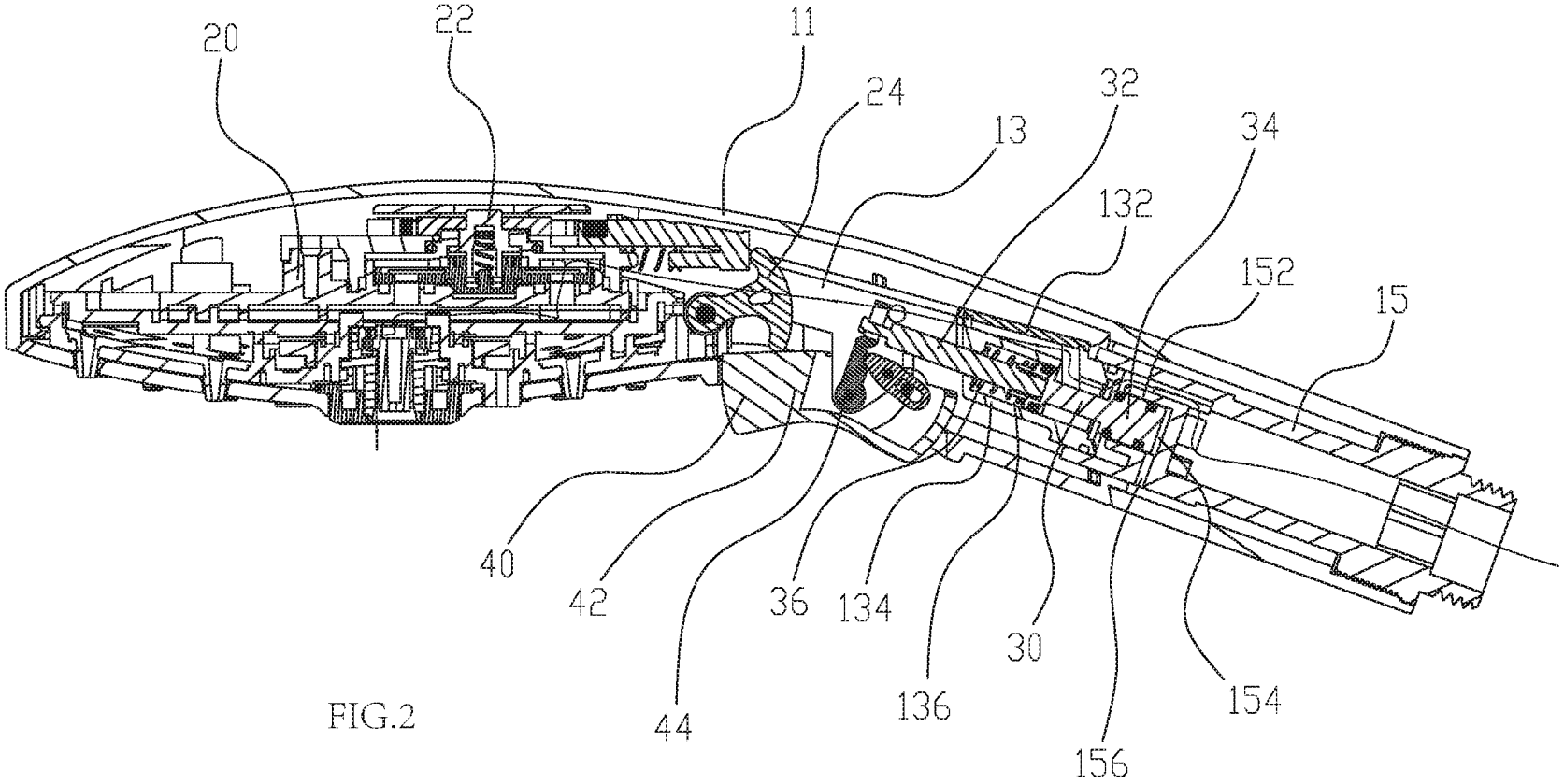
FIG. 2 illustrates a sectional diagram of the shower head of FIG. 1.
Figure 3:
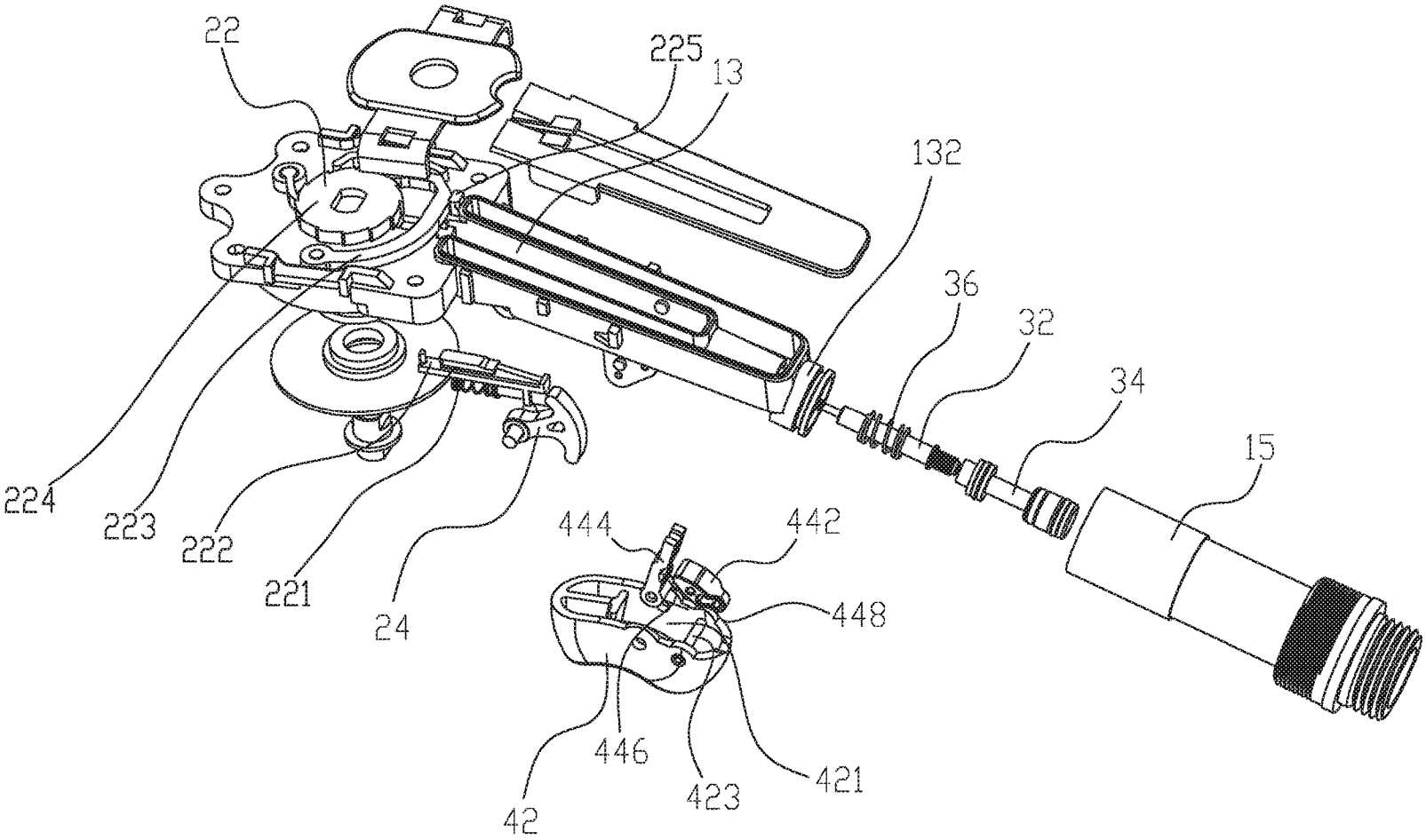
FIG. 3 illustrates an exploded diagram of the switch device, the water stop device and the control device of the shower head of FIG. 1.

Referring to FIGS. 1-3, a shower head with water stop function and waterway switch function of the present invention comprises a housing 10, a switch device 20, a water stop device 30 and a control device 40, the switch device 20 and the water stop device 30 are disposed in the housing 10, the control device 40 is connected between the switch device and the water stop device. The switch device 20 is used to switch the waterways, the switch device 20 comprises a switch mechanism 22 and a swing mechanism 24 connected together in driving way, the switch mechanism 22 comprises a reset spring 221, a connecting bar 222, a ratchet 223, a ratchet wheel 224 and a stop block 225, the swing mechanism 24 can push the connecting bar 222 to move forwardly to drive the ratchet 223 to rotate, the ratchet 223 rotates to drive the ratchet wheel 224 to rotate so as to achieve waterway switch. The water stop device 30 is used to control the on-off of the shower head, the water stop device 30 comprises a valve shaft 32 and a valve spool 34 connected together and an elastic element 36 sleeved on the valve spool, the valve shaft 32 drives the valve spool to move axially between an open position and a close position to turn on and turn off the waterway, the elastic element 36 is compressed when in the open position and the close position, the elastic reset force in the open position is smaller than that in the close position. The control device 40 comprises a button 42 and a link mechanism 44, the central portion of the button 42 is pivoted to the housing 10, the link mechanism 44 is connected between the valve shaft 32 and the button 42 in driving way. The housing 10 comprises a case 11, an assembly base 13 disposed in the case and a connecting pipe 15, the housing 10 is disposed with a block column 12, the block column 12 is disposed at the assembly base 13.

Figure 4:
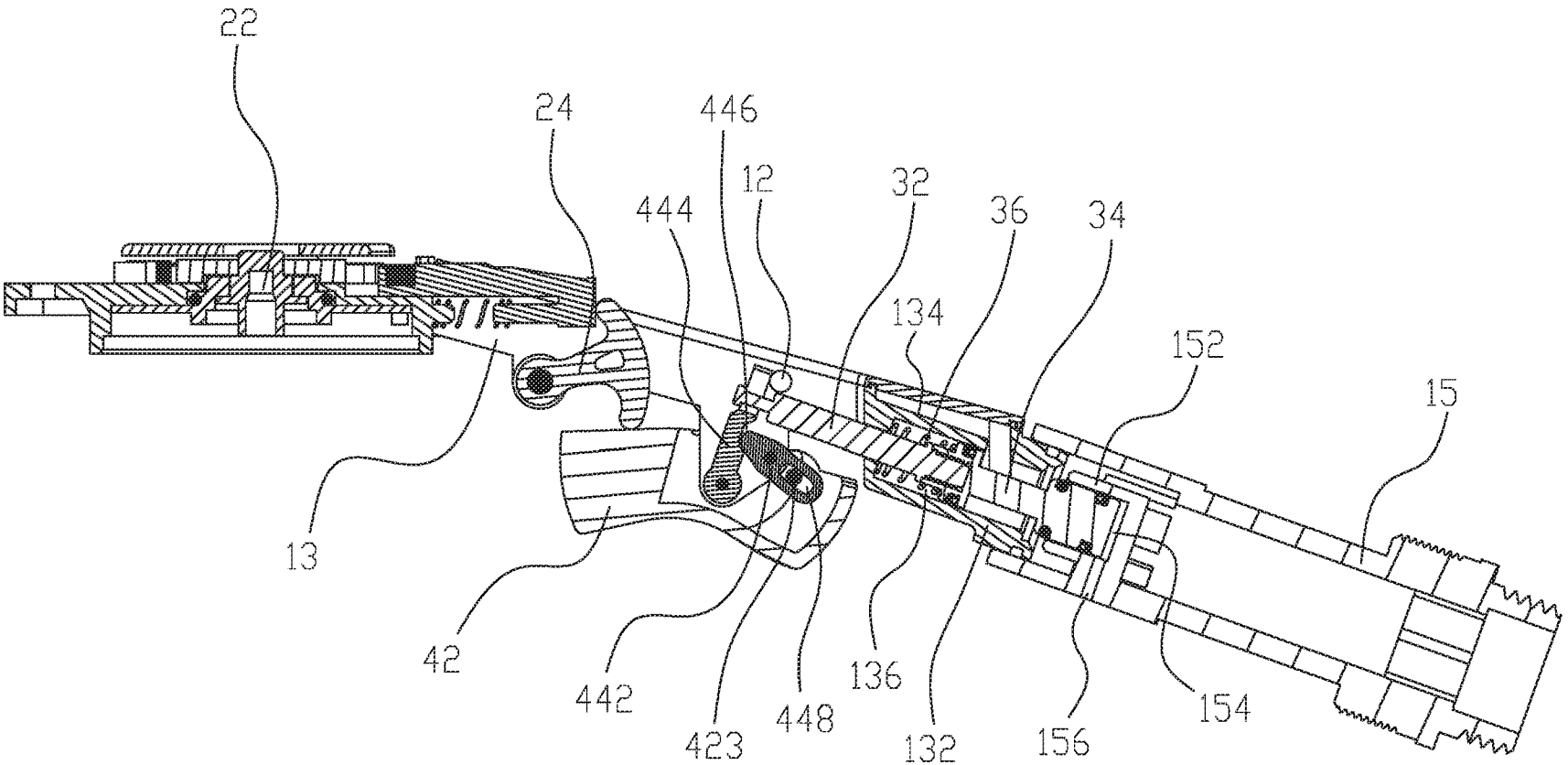
FIG. 4 illustrates a schematic diagram of the water stop device of the shower head of FIG. 1 when the waterway is open.

When the front portion of the button 42 is pressed, the button 42 pushes the swing mechanism 24 to swing in the counter-clockwise direction to make the switch mechanism 22 rotate, when the button 42 is released, the waterway is switched one time, at the same time, the link mechanism 44 keeps the valve spool 34 in the open position under the action of the button 42, as figured in FIG. 4.

Figure 5:
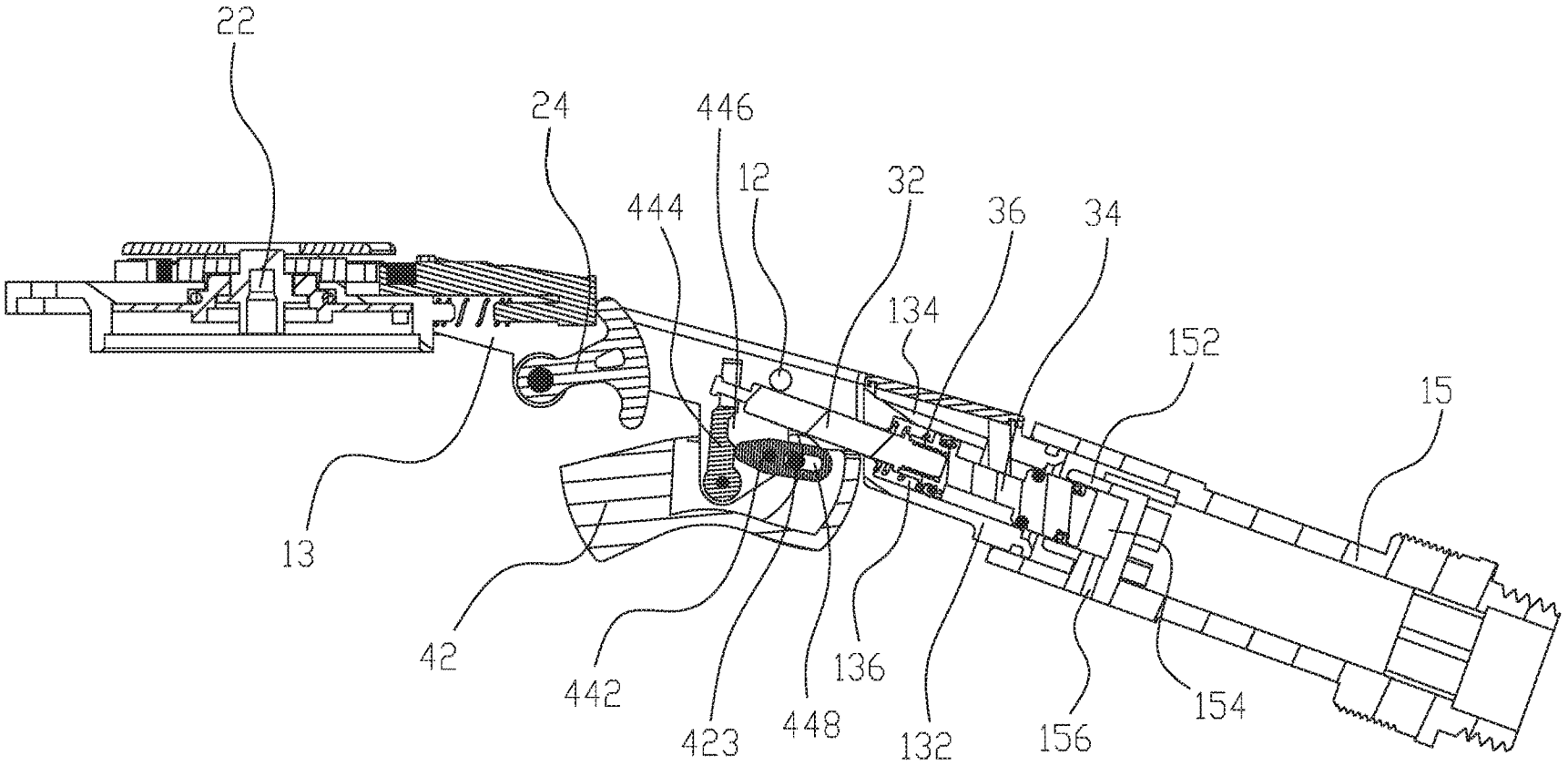
FIG. 5 illustrates a schematic diagram of the water stop device of the shower head of FIG. 1 when the waterway is closed.

When the rear portion of the button 42 is pressed, the button 42 pulls the link mechanism 44 to make the valve spool 34 move to the close position to turn off the waterway, meanwhile, the switch device keeps still, as figured in FIG. 5. When the button 42 is released, the valve spool 34 keeps in close position.

The link mechanism 44 comprises a push rod 442 and a pendulum rod 444. The rear portion of the button 42 is disposed with a chamber 421, the push rod 442 is rotatably disposed in the chamber about the central portion, the pendulum rod 444 is rotatably disposed in the chamber 421 about the bottom portion, the top portion of the pendulum rod 444 is connected to the valve shaft 32, the central portion of the pendulum rod 444 is disposed with a groove 446. The rear end portion of the push rod 442 is disposed with an elongated through hole 448, the button 42 is disposed with a fixing pin 423, the fixing pin 423 passes through the elongated through hole 448. In water supplying state, when the front portion of the button 42 is pressed, the button 42 pushes the swing mechanism 24 to make the switch mechanism 22 switch waterways, the button 42 drives the fixing pin 423 to move in the through hole 448, and then drives the push rod 442 to separate from the pendulum rod 444, making the valve spool 34 keep in the open position. At the same time, as the pendulum rod 444 is pressed on the block column 12, the elastic restoring force of the elastic element 36 acting on the pendulum rod 444 can not act on the push rod 442, so the button 42 is not influenced by the link mechanism 44. When the force to the button 42 is released, the connecting bar 222 moves backwardly to drive the swing mechanism 24 to swing in clockwise direction by the action of the elastic restoring force of the elastic element 221, the button 42 returns to its initial state, at the same time, the connecting bar 222 drives the ratchet 223 to move backwardly, when the ratchet 223 moves to a certain position, it abuts against the block column 225, such that the connecting bar 222 doesn't move any more, the button 42 keeps in the initial state.

When the rear portion of the button 42 is pressed, the button 42 drives the fixing pin 423 to move in the through hole 448, and drives the push rod 442 to rotate to make the front end portion of the push rod move out of the groove 446 to abut against the pendulum rod 444, such that the pendulum rod rotates in counter-clockwise direction to pull the valve shaft 32 up, the valve spool 34 closes the waterway, the pendulum rod 444 and the push rod 442 form a self-lock, the water stop device 30 keeps in water stop state.

In water stop state, when the front portion of the button 42 is pressed, the fixing pin 423 moves in the through hole 448, driving the push rod 442 to separate from the pendulum rod 444, the valve shaft 32 drives the valve spool 34 to move from the close position to the open position under the action of the elastic restoring force of the elastic element 36. When the front portion of the button 42 is pressed down continuously, the button 42 pushes the swing mechanism 24 to make the switch mechanism 22 switch the waterways.

The button 42 is pivoted to the assembly base 13; one end of the assembly base 13 is disposed with a shaft sleeve 132, the shaft sleeve 132 is sleeved on the connecting pipe 15. One end of the valve shaft 32 extends axially out of the shaft sleeve 132 to connect to the pendulum rod 444 of the link mechanism; one end of the valve spool 34 is connected to the valve shaft 32, the other end of the valve spool 34 is inserted into the connecting pipe 15. The connecting pipe 15 is disposed with a plug base 152, the plug base 152 is disposed with a sliding groove 154, the other end of the valve spool is movably disposed in the sliding groove, the connecting pipe is disposed with a through hole 156, which is connected to the sliding groove; a water passage is formed between the plug base 152 and the internal wall of the connecting pipe 15. A position base 134 is disposed in the shaft sleeve 132, the position base 134 is disposed with a guiding groove 136, one end of the valve spool 34 is slidably disposed in the guiding groove, the elastic element 36 is disposed in the guiding groove and is pressed on the valve spool 34, a water passage is formed between the position base 134 and the internal wall of the shaft sleeve 132; the valve spool 34 has thin center and thick ends, the section area of the two ends of the valve spool are equal. Such that, water pressure on the two ends of the valve spool are equal in water supplying state and water stop spate, the valve spool moves easily.

The housing 10 comprises a cover portion 14 and a handle portion 16, the switch device 20 is disposed at the cover portion 14, and the water stop device 30 is disposed at the handle portion 16.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A shower head having, in combination, a water stopping function and a waterway switching function for switching among multiple waterways, comprising:

a housing connected to a water source;

a switching device that is disposed in the housing and that comprises a switching mechanism that switches among the multiple waterways, and a swing mechanism that is connected to the switching mechanism and that pushes the switching mechanism to switch from one waterway of the multiple waterways to another waterway of the multiple waterways;

a water stop device that is disposed in the housing and that comprises a valve shaft and a valve spool which are connected together so that the valve shaft drives the valve spool to move axially into an open position or into a closed position to turn on or off water supply from the water source to the shower head; and a control device that comprises a button; and a linking mechanism, a central portion of the button being pivotally mounted to the housing and the linking mechanism being connected between the valve shaft and the button so that pressing the button drives the valve shaft, wherein, when a front portion of the button is pressed, the button pivots to push the swing mechanism to switch from the one waterway to the another waterway, and the button drives the linking mechanism to cause the valve spool to turn on the water supply to the shower head, and wherein, when a rear portion of the button is pressed, the button pivots to pull the linking mechanism to cause the valve spool to turn off the water supply to the shower head.

2. The shower head according to claim 1, wherein the linking mechanism comprises a push rod and a pendulum rod, wherein a rear portion of the button is disposed with a chamber, the push rod being rotatably disposed in the chamber, and the pendulum rod being rotatably disposed in the chamber, wherein a top portion of the pendulum rod is connected to the valve shaft, wherein a central portion of the pendulum rod is disposed with a groove, wherein, when the front portion of the button is pressed, the button pivots to drive the push rod to rotate and cause a front-end portion of the push rod to separate from the pendulum rod, and wherein, when the rear portion of the button is pressed, the button pivots to drive the push rod to rotate and cause the front-end portion of the push rod to move out of the groove and to abut against the pendulum rod.

3. The shower head according to claim 2, wherein a rear end portion of the push rod has defined therein an elongated through hole, the button is disposed with a fixing pin, and the fixing pin passes through the elongated through hole.

4. The shower head according to claim 1, wherein the housing is disposed with a block column;

wherein the water stop device further comprises an elastic element that is configured to apply an elastic force to the valve spool to cause the valve spool to move to the open position, and wherein the linking mechanism is abuttable against the block column.

5. The shower head according to claim 4, wherein the housing further comprises a case; an assembly base including ends; and a connecting pipe disposed in the case, wherein the central portion of the button is pivotally mounted to the assembly base, and the block column is disposed at the assembly base, wherein one end of the assembly base is disposed with a shaft sleeve that is sleeved on the connecting pipe, and one end of the valve shaft extends axially out of the shaft sleeve to connect to the linking mechanism, and wherein the valve spool has ends and one end of the valve spool is connected to the valve shaft and another end of the valve spool is inserted into the connecting pipe.

6. The shower head according to claim 5, wherein the connecting pipe is disposed with a plug base having defined therein a sliding groove, wherein the another end of the valve spool is movably disposed in the sliding groove and;

wherein a water passage is formed between the plug base and an internal wall of the connecting pipe.

7. The shower head according to claim 6, wherein the connecting pipe has defined therein a through hole that is connected to the sliding groove, and air in the sliding groove exhausts out of the shower head through the through hole.

8. The shower head according to claim 6, wherein a position base is disposed in the shaft sleeve and has defined therein a guiding groove in which the another end of the valve spool is slidably disposed and in which the elastic element is disposed and is pressed onto the valve spool, wherein a water passage is formed between the position base and an internal wall of the shaft sleeve, and wherein the valve spool has a thin center and two thick ends, the two thick ends having equal cross-sectional areas.

9. The shower head according to claim 1, wherein the housing comprises a cover portion in which the switching device is disposed; and a handle portion at which the water stop device is disposed.

10. The shower head according to claim 1, wherein, when the rear portion of the button is pressed and then released, the valve spool remains in the closed position, and wherein, when the front portion of the button is pressed and then released, the valve spool remains in the open position.

11. The shower head according to claim 1, wherein, when in a water supplying state and the front portion of the button is pressed, the button pivots to push the swing mechanism to achieve a waterway switch, wherein, when in a water stop state and the front portion of the button is pressed, the button pivots to drive the linking mechanism to make the valve spool turn on the water supply to the shower head, and wherein, when the front portion of the button is continuously pressed, the button pushes the swing mechanism to achieve the waterway switch.

12. The shower head according to claim 1, wherein the switching mechanism comprises a reset spring; a connecting bar; a ratchet; a ratchet wheel; and a stop block, wherein, when the front portion of the button is pressed, the swing mechanism pushes the connecting bar to move forwardly to drive the ratchet to rotate to drive the ratchet wheel to rotate and to achieve a waterway switch, and wherein, when the button is released, under the action of the reset spring, the connecting bar drives the ratchet to move backwardly until the ratchet abuts against the stop block to cause the button to reset.

* * * * *